United States Patent [19]

Holz et al.

[11] Patent Number: 4,767,266

[45] Date of Patent: Aug. 30, 1988

[54] SEALING RING FOR AN AXIAL COMPRESSOR

[75] Inventors: Robert G. Holz, Vert Saint Denis; Georges Karadimas, Vanves, both of France

[73] Assignee: Societe Nationale d'Etude et de Construction de Moteurs d'Aviation (SNECMA), Paris, France

[21] Appl. No.: 24,864

[22] Filed: Mar. 13, 1987

Related U.S. Application Data

[63] Continuation of Ser. No. 696,468, Jan. 30, 1985, abandoned.

[30] Foreign Application Priority Data

Feb. 1, 1984 [FR] France ..... 84 01530

[51] Int. Cl.[4] ..... F16J 15/447; F01D 11/08

[52] U.S. Cl. ..... 415/172 A; 277/53; 415/170 R

[58] Field of Search ..... 415/172 A, 172 R, 174, 415/170 R; 277/53–57

[56] References Cited

U.S. PATENT DOCUMENTS

| | | | |
|---|---|---|---|
| 1,482,031 | 1/1924 | Parsons et al. | 277/57 |
| 3,119,624 | 1/1964 | Freed | 277/208 X |
| 3,144,256 | 8/1964 | Wright | 277/208 |
| 3,414,272 | 12/1968 | Rogers, Jr. | 277/215 X |
| 3,558,238 | 1/1971 | Van Herpt | 277/53 X |
| 4,022,479 | 5/1977 | Orlowski | 277/53 |
| 4,055,041 | 10/1977 | Adamson et al. . | |
| 4,175,752 | 11/1979 | Orlowski | 277/53 |
| 4,273,343 | 6/1981 | Visser | 277/203 X |
| 4,320,903 | 3/1982 | Ayache et al. | 277/53 X |
| 4,466,772 | 8/1984 | Okapuu | 415/170 R X |

FOREIGN PATENT DOCUMENTS

| | | | |
|---|---|---|---|
| 121156 | 2/1931 | Austria | 277/53 |
| 1700164 | 12/1970 | Fed. Rep. of Germany . | |
| 1218301 | 5/1960 | France . | |
| 1348186 | 11/1963 | France . | |
| 2406074 | 5/1979 | France . | |
| 2432105 | 2/1980 | France . | |
| 2440467 | 5/1980 | France . | |
| 225936 | 12/1924 | United Kingdom | 277/53 |
| 615961 | 1/1949 | United Kingdom | 277/53 |
| 874010 | 8/1961 | United Kingdom | 277/208 X |
| 2092681A | 8/1982 | United Kingdom . | |

*Primary Examiner*—Allan N. Shoap
*Attorney, Agent, or Firm*—Bacon & Thomas

[57] ABSTRACT

A system for sealing the peripheries of rotating rotor blades is disclosed in which a seal ring is mounted to the stationary casing adjacent the blade tips. The inner surface of the seal ring defines a plurality of grooves, each groove having a generally triangular shaped cross section. The longitudinal and radial dimensions of the grooves may be identical, or may vary along the longitudinal direction of the seal ring.

5 Claims, 1 Drawing Sheet

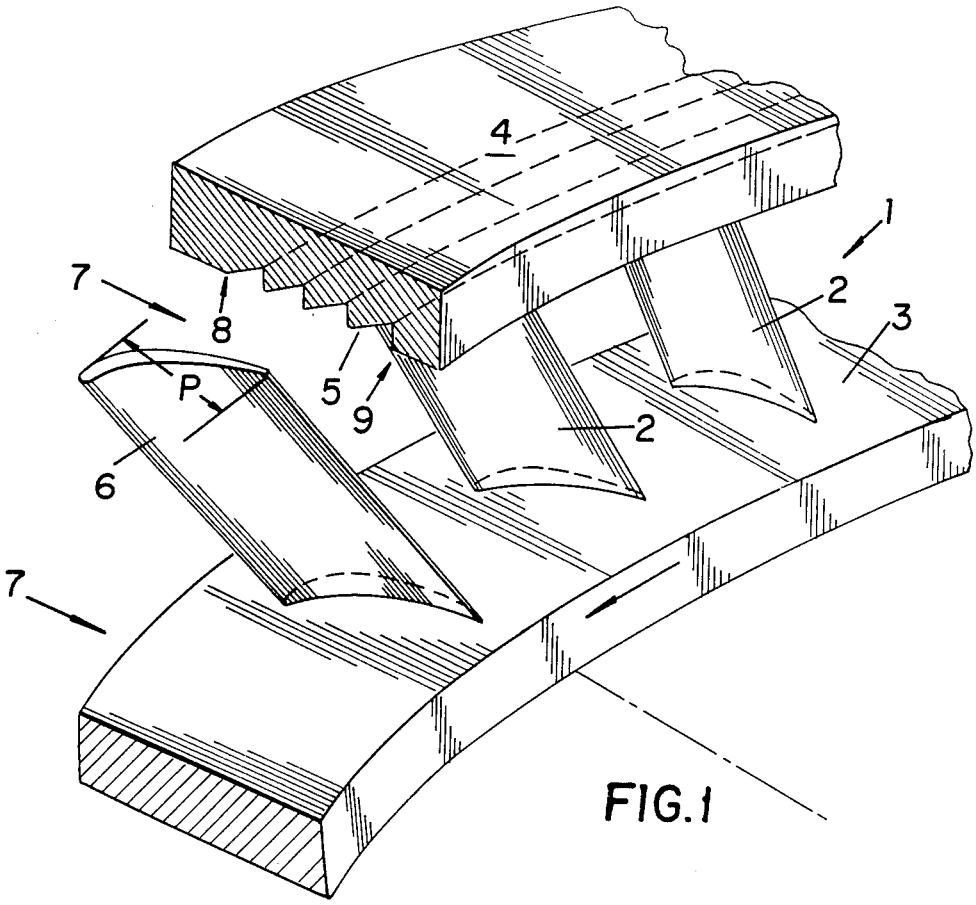
FIG.1
FIG.2
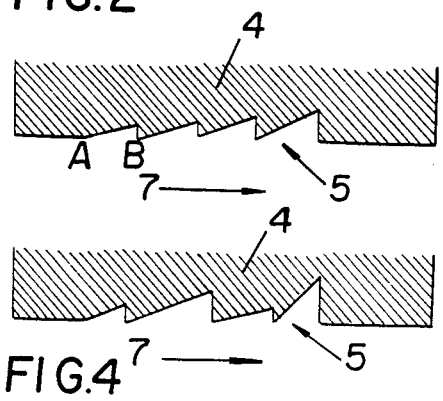
FIG.4
FIG.3
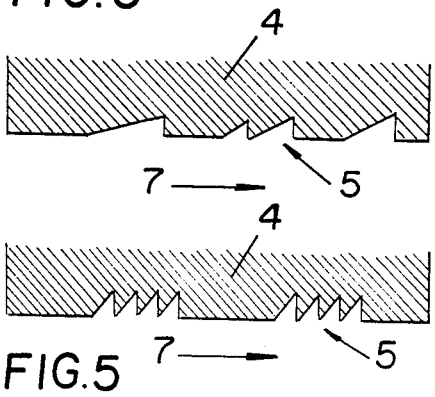
FIG.5

SEALING RING FOR AN AXIAL COMPRESSOR

This application is a continuation, of application Ser. No. 696,468, filed Jan. 30, 1985 now abandoned.

BACKGROUND OF THE INVENTION

1. Field of the Invention

The instant invention relates to a peripheral sealing device for an axial compressor, specifically such a device wherein a seal ring defining a plurality of grooves on its inner surface is disposed about the rotating rotor blades.

2. Brief Description of the Prior Art

Achieving an effective seal between the periphery of the rotating blades and the stationary casing of an axial compressor is a fundamental necessity for achieving and maintaining high operational efficiencies. While such peripheral leaks in turbines result only in a loss in efficiency affecting the specific fuel consumption, such leaks in compressors of the axial type generate secondary phenomena that strongly affect the stability of the flowing gases and the stability of the compressor itself.

It is well known in the art to attach abrading material to the interior of the stationary casing such that it is worn away by the tips of the rotor blades so as to minimize the clearance between the blade tips and the stationary casing. However, during the run-in period for such compressor blades, the blades can also be worn or deformed at their ends during their centrifugal elongation resulting in a detachment of the flow of the gases passing over the casing and introduces a random friction energy into the blading which may induce periodic vibration corresponding to the critical period of the rotating mass.

It is further known to form the tips of the rotor blades in a step-like formation and to machine a corresponding formation into the wall of the stationary casing. Such a system is shown in French Pat. No. 1,218,301. Generally, the interior wall of the casing converges in step-like fashion in the direction of the flow such that the leak flow current indicent on the vertical wall of the step is deflected in a tangential direction. While this system is somewhat effective, it requires delicate machining of both the turbine blades and the stationary casing, thereby resulting in a high manufacturing cost.

The system shown in French Pat. No. 2,432,105 eliminates the necessity of forming the step-like formation on the rotor blade tips and merely forms a plurality of discontinuities, in the shape of circumferential grooves or axially extending cavities in the casing wall adjacent to the blade tips. Due to the thermal and centrifugal expansion of the rotor blade and rotor blade wheel, the tips of the blades enter into the cavities during operation to seal the gas flow. However, experience has shown tht this system does not markedly improve the efficiency of the device, due to the detachment of the gas flow produced on the descending step of the peripheral passage. This system also introduces additional complex mechanical problems due to the axial displacement of the rotor blade and wheels which may cause the blade tips to contact the stationary casing.

The sealing system shown in French Pat. No. 2,440,467 utilizes a plurality of generally radially extending circumferential grooves in the casing adjacent the rotor blade tips to thicken the boundary layer so as to counteract the leakage flow. However, it has been found that increasing the thickness of the boundary layer entails greater susceptibility to the detachment of the gas flow, which is undesirable.

SUMMARY OF THE INVENTION

The instant invention obviates the mechanical and functional drawbacks of the prior art devices in order to provide an effective seal at the tips of the rotor blades. This is accomplished by a seal ring, which is attached to the stationary casing adjacent the rotor blade tips, which seal ring defines a plurality of generally circumferential grooves. The grooves extend beyond the longitudinal distance of each of the rotor blades in both the upstream and downstream direction. Each of the grooves has a generally triangular-shaped cross section, with a first side extending in a generally radial direction perpendicular to the longitudinal axis of the compressor, while the second side (forming the hypotenuse of the triangle) extends at an acute angle to the longitudinal axis.

BRIEF DESCRIPTION OF THE DRAWINGS

FIG. 1 is a partial perspective view, partially broken away, showing a sealing system according to the invention.

FIGS. 2 through 5 are cross sections of the seal ring shown in FIG. 1, showing alternative embodiments of the arrangement of the grooves.

DETAILED DESCRIPTION OF THE PREFERRED EMBODIMENTS

As shown in FIG. 1, the improved sealing device is disposed about the periphery of rotor structure 1 which comprises rotor wheel 3 to which a plurality of blades 2 are attached. Seal ring 4 is attached to a stationary casing (not shown) such that its inner surface lies in close proximity to the tips of each of the blades 2. The inner surface of ring 4 defines a plurality of generally circumferentially extending grooves 5, each groove having a generally triangular shape in cross section. Ring 4 may be made of an abrading material, although this is not necessary, and is oriented such that its inner surface is close to the straight tips 6 of the rotor blades 2. The direction of the gas or fluid flow is shown by arrows 7 in FIG. 1.

The circumferential grooves forming the sealing system according to the invention take the form of a sequence of small diffusers or radial steps, the radial portion of each of the grooves facing the upstream direction of the fluid flow. As can be seen, each of the grooves has a cross section that is in the general shape of a right triangle, wherein a first side extends generally perpendicular to the longitudinal axis of the compressor and the second side (forming the hypotenuse of the triangle) extends at an acute angle to the longitudinal axis.

The distance between the forwardmost portion 8 of the upstream groove and the rearmost portion 9 of the downstream groove is greater than the longitudinal dimension p between the leading and trailing edges of the rotor blades 2.

As seen in FIG. 1, each of the grooves has approximately equal longitudinal dimensions and approximately equal maximum radial dimensions. In an alternative embodiment shown in FIG. 2, the longitudinal dimensions of each groove remains equal, but the maximum radial dimension of each groove increases in a downstream direction.

The embodiments shown in FIGS. 3 and 4 show applications wherein the grooves are not uniformly distributed in the longitudinal direction of the ring, and where the longitudinal dimension and the maximum radial dimensions of the grooves may vary. The affect of the radial play is affected by specific sides of the seal ring, in which case it is necessary to compensate for these anamolies by an irregular array of the grooves which are controlled by their depths.

FIG. 5 illustrates an alternative embodiment in which the grooves are symmetrically arranged with respect to a radial plane of symmetry of the blade.

The grooves may be formed by one or more helical notches machined in the inner surface of the seal ring 4. The helical notches contribute to deflecting the radial component of the gas flow in the normal direction and to oppose reverse flow.

When the seal ring 4 is made of an abrading material, it can be molded or machined as removable shells as described in French Pat. No. 2,452,601. This form offers a greater ease of maintenance and provides effective damping of the casing vibrations.

The selection of the different embodiments of the peripheral seals is determined by the following considerations:

the radially outwardly extending first side of the groove does not cause the gas flow to detach as is the case for a descending, or inwardly extending step and, thereby, the "buried play" caused by running-in and by the penetration of the blade tips into the abrading material is avoided;

the effective range of turbulence forming at the leading and trailing edges of the shapes indicates that the affect of the radial play is much more pronounced at given sites along the cord joining the leading edge to the trailing edge of the blade tips and the optimal sealing planes can be positioned at these locations;

the presence of a compressible volume above the rotating blades provides a margin for detachment of the flow; and the frictional surfaces of the blade tips and, hence, the amount of energy passing into the blades, are considerably reduced.

The foregoing is provided for illustrative puroses only and should not be construed as in any way limiting this invention, the scope of which is determined solely by the appended claims.

What is claimed is:

1. In an axial compressor having a longitudinal axis, a stationary casing and at least one rotor wheel the improvements comprising:

(a) a plurality of blades extending radially outwardly from the rotor wheel such that the rotor wheel is rotated about the longitudinal axis by gases passing across the blades from an upstream side to a downstream side in a direction generally parallel to the longitudinal axis, each of the blades defining a straight tip extending substantially parallel to the longiudinal axis; and (b) a generally annular seal ring mounted on the casing, to seal between the casing and the straight tips of the blades, the seal ring having a generally cylindrical inner surface extending substantially parallel to the longitudinal axis adjacent the straight tips of the rotor blades, the inner surface having a greater dimension in the longitudinal direction than that of the rotor blades and defining a plurality of grooves extending around the seal ring and opening radially inwardly toward the rotor blades, said grooves each extending radially outwardly from said cylindrical inner surface, the cross section of each groove defined by a first side extending generally perpendicular to the longitudinal axis and a second side extending at an acute angle to the longitudinal axis, such that the first side of each groove is located downstream of the second side of the corresponding groove wherein the longitudinal distance between an upstream extremity of the second side of a first groove and a downstream extremity of a first side of a second groove is greater than the longitudinal dimension of the blade tips.

2. The axial compressor according to claim 1 wherein the longitudinal dimensions of each groove are approximately equal.

3. The axial compressor according to claim 2 wherein the maximum radial dimensions of each groove are approximately equal.

4. The axial compressor according to claim 2 wherein each groove has a different maximum radial dimension.

5. The axial compressor according to claim 4 wherein the maximum radial dimensions increase in a downstream direction.

* * * * *

UNITED STATES PATENT AND TRADEMARK OFFICE

CERTIFICATE OF CORRECTION

PATENT NO. : 4,767,266

DATED : August 30, 1988

INVENTOR(S) : HOLZ et al

It is certified that error appears in the above-identified patent and that said Letters Patent is hereby corrected as shown below:

Col. 1, line 42, "indicent" should be --incident--.

Col. 1, line 55 "tht" should be --that--.

Col. 3, line 47, "puroses" should be --purposes--.

Signed and Sealed this

Seventh Day of February, 1989

*Attest:*

*Attesting Officer*

DONALD J. QUIGG

*Commissioner of Patents and Trademarks*